US005718000A

United States Patent [19]

Ost et al.

[11] Patent Number: 5,718,000

[45] Date of Patent: Feb. 17, 1998

[54] MODULAR, ALL SEASON MULTI-COMPARTMENT CLOTHING

[76] Inventors: Lynn Van Ost; Karen R. Manfre, both of 2 Riverview Dr., West Trenton, N.J. 08628

[21] Appl. No.: 756,279

[22] Filed: Nov. 25, 1996

[51] Int. Cl.[6] ..... A41D 3/02

[52] U.S. Cl. ..... 2/69; 2/85; 2/93; 2/94; 2/102; 2/108

[58] Field of Search ..... 2/108, 85, 93, 2/94, 69, 69.5, 102, 79

[56] References Cited

U.S. PATENT DOCUMENTS

| | | | |
|---|---|---|---|
| D. 251,936 | 5/1979 | Shaw . | |
| 3,611,444 | 10/1971 | Rector . | |
| 4,041,549 | 8/1977 | Atkiason . | |
| 4,158,892 | 6/1979 | Gonzales | 2/79 |
| 4,261,059 | 4/1981 | Spitz . | |
| 4,347,629 | 9/1982 | Itoi | 2/108 |
| 4,470,155 | 9/1984 | Maeshina . | |
| 4,554,682 | 11/1985 | Hillquist . | |
| 4,569,089 | 2/1986 | Nesse . | |
| 4,843,647 | 7/1989 | Phillips . | |
| 4,864,656 | 9/1989 | Nesse . | |
| 5,054,127 | 10/1991 | Zevchak . | |
| 5,063,614 | 11/1991 | MeSheffery . | |
| 5,072,456 | 12/1991 | Elin . | |
| 5,077,838 | 1/1992 | Senser . | |
| 5,201,075 | 4/1993 | Svetich . | |

OTHER PUBLICATIONS

Cabela's 1994—Annual Fall Catalog; p. 45—Water Fowler 4-way Parka & p. 69 3-in-1 Parka.

*Primary Examiner*—Gloria Hale
*Attorney, Agent, or Firm*—Kenneth P. Glynn

[57] ABSTRACT

A multi-compartment, modular jacket includes a vest which has a vest front panel, a vest rear panel, a pair of armholes and a fastener for opening the vest. A plurality of pockets covers the outer surface of the vest. The vest has a fastener for releasably attaching a pair of detachable sleeves to the pair of armholes. The inner jacket has a front panel, a rear panel, a pair of sleeves and a means for opening the inner jacket. The exterior surface of the rear panel has a pouch. A plurality of pockets covers the pouch and the exterior surface. The inner jacket has a collar which contains a collapsible hood. A first composite jacket is formed by fastening the vest to the inner jacket. The first composite jacket has an outside surface which is the exterior surface and an inside surface which is the outer surface. The outer jacket has a jacket front panel, a jacket rear panel, a first pair of sleeves and a fastener for opening the outer jacket. A third plurality of pockets cover the external and the internal surfaces. The outer jacket has a collar which has a removable hood. A second composite jacket is formed via a fastener, which extends around an outer seam of the first composite jacket and of the outer jacket.

20 Claims, 4 Drawing Sheets

MODULAR, ALL SEASON MULTI-COMPARTMENT CLOTHING

BACKGROUND OF THE INVENTION

1. Field of the Invention

The present invention relates in general to jackets having all year usability. Specifically, the present invention provides a multi-functional jacket which has three separte layers and is convertible between an outer jacket, an inner jacket, a trainers vest and a combination of all three layers. More specifically, each jacket type has multiple pockets for the holding of various items.

2. Description of the Prior Art

The following patents describe jackets which attempt to provide all season wear and try to provide multi-purpose and multi-functional features.

U.S. Pat. No. Des. 251,936 to Ted G. Shaw illustrates a combined jacket and detachable pack, or similar article.

U.S. Pat. No. 3,611,444 to C. T. Rector describes a detachable pocket for wearing apparel. The detachable pocket has two layers which are connected via a continuous seam. Access to the interior of the pocket is accomplished by cutting a slit in the side of the detachable pocket which is attached to the wearing apparel. When the pocket is attached it automatically seals the opening in the pocket. The pocket is attached via loop and hook mechanisms.

U.S. Pat. No. 4,041,549 to Paul Ray Atkinson describes a jacket which has vertical paneling on the front of a vest which can attach/detach pockets (using filamentary loop and hook mechanisms) and a back pocket which is formed by attaching a flap section to the body of the jacket.

U.S. Pat. No. 4,261,059 to Louis Spitz discloses a jacket having removable sleeves and hoods. The jacket has an internal retaining means for holding the detached sleeves and thereby increasing the thermal characteristics of the jacket. The sleeves are attached to the jacket via zippers and are retained in the jacket using loop and hook mechanisms.

U.S. Pat. No. 4,470,155 to Seiichi Maeshima describes a jumper which is convertible to and from a thick type jumper to a thin type jumper by detachably attaching a liner. The jumper is constructed such that the liner can be held within the jumper itself when not desired.

U.S. Pat. No. 4,554,682 to Paul A. Hillquist describes a jacket which is convertible between a vest and a jacket with sleeves and/or with a hood. The convertible jacket consists of a sleeveless body garment and an upper component. The upper component has two sleeve portions connected by a yoke portion incorporating a neckhole and optionally, a neckhole extension such as a collar or hood. The two parts are attached together via buttons at specific places.

U.S. Pat. No. 4,569,089 to Gary E. Nesse describes a garment which can be converted from a jacket to a vest and back. The jacket has retractable sleeves which are rolled into a pair of sleeve storage compartments, which encircle the arm holes. The jacket also has a retractable hood which is storable in a hidden compartment around the neck hole. Retractable safety panels are featured on the back of the jacket, as is a day pack (i.e. a back pocket). There is also a means for adjusting the tightness of the jacket around the torso of the user.

U.S. Pat. No. 4,843,647 issued to James G. Phillips, St. describes a cold weather system for keeping a wearer comfortable in a temperature range of about −60° F. to +40° F. and in winds up to 100 miles per hour. The system comprises a shirt, pants, parka, wind shirt and wind pants.

The shirt and pants are ventable so that they provide comfort over a wide temperature range, the vents being completely closed when maximum thermal protection is desired. The parka includes a windskirt which engages the wearer's legs. The parka and the wind shirt can be connected together to provide an emergency bivouac sleeping bag.

U.S. Pat. No. 4,864,656 to Gary E. Neese describes a removable insert assembly which can be used in combination with jackets and/or vests to provide thermal insulation during cold weather. The insert assembly can also be manufactured with ballistic material to provide removable body armor. It could also be constructed as a personal flotation device.

U.S. Pat. No. 5,054,127 issued to Eric Scott Zevchak discloses a system of interchangeable pockets which can be used on any type of clothing. A first type of fastening device is attached to the item of interest. A complementary fastening device is attached to the pocket itself, which is then attachable to the item of interest.

U.S. Pat. No. 5,063,614 to Kenneth E. McSheffery discloses a reversible fishing garment which has exterior flaps attached to the right and left torsal portions. Each exterior flap opens outwardly from the wearer's body to expose a plurality of easily accessible clear plastic pockets that are detachably secured to the interior of the flaps.

U.S. Pat. No. 5,072,456 to Lewis R. Elin discloses an outer garment for use by emergency medical services personnel. The garment is provided with an exterior tool holster panel positioned on the exterior of the front of the garment. The holster includes a plurality of pockets each adapted to receive a piece of emergency medical equipment. The tool holster is hingedly attached at the top so that it can easily swing out from the body when the user is bent over a victim.

U.S. Pat. No. 5,077,838 to Dane E. Senser discloses a convertible, outerwear garment comprising a vest which has an interior pocket containing sleeves and an interior section connecting the two sleeves. It further includes a pocket on the back which holds a compressed pouch and hood for rainy conditions.

U.S. Pat. No. 5,201,075 to Ronald J. Svetich discloses an athlete's arm jacket which includes a first and a second shell portion, each having a sleeve portion which is removably attached, for covering both sides of the upper torso of a person wearing the jacket. Each shell has an interior mesh portion which is exposed when the sleeve portion is removed from either the first or second shell portion.

Notwithstanding the above prior art, it is believed that the jacket set forth herein is neither taught nor rendered obvious.

SUMMARY AND OBJECTS OF THE INVENTION

The present invention is an all season modular, multi-compartment clothing. The clothing has three layers, namely, an outer jacket, an inner jacket and a vest with detachable sleeves. The layers can be worn separately or in combination with each other. For example, the vest can be used during the summer for hiking, fishing, as a sports trainer's vest and other similar activities. The vest can then be modified by adding the detachable sleeves so that the user can use it during spring on those cool but pleasant days. The inner jacket, either separately or in combination with the vest, can be used as a windbreaker for cool, windy days or rainy, blustery days during the fall months. Finally, the outer jacket, either separately or in combination with the others, can be used during cold, wintery days. The three layer construction provides added warmth and flexibility in use.

Each layer of the clothing has a plurality of pockets which can be used by the user to store a multitude of items.

As stated, the clothing consists of three layers, which can be worn concurrently or separately. The vest can be attached to the inner jacket by a fastener which extends around the entire outer seam of both the vest and the inner jacket. In making the attachment, the vest is turned inside out, and then attached to the inner jacket. As such, the resulting composite jacket has pockets on both the inside and outside. The composite jacket or the inner jacket is also attachable to the outer jacket by a continuous fastener, which extends around the entire outer seam of the medium weight or inner and outer jackets, including the neck opening. This continuous fastener ensures the warmest possible seal between the two or three layers. This final composite jacket would also have pockets on the outside and the inside.

In one embodiment, the inner and outer surfaces of each of the layers have detachable pockets. That is, each individual layer has a plurality of inner and outer removable pockets which are located around the entire surface of each of the layers. The pockets are removably attached so that the user can replace a large single pocket with a plurality of smaller pockets and vice versa.

In other embodiments, the outer jacket has a detachable apron which extends from the back side downwardly to provide added wet weather protection. In addition, the outer jacket has a detachable hood and the inner jacket has a collar which contains a collapsible hood.

The present invention accomplishes the above functionality and corrects the defects of past devices by providing a multi-compartment, modular jacket which includes a vest which has a vest front panel, a vest rear panel and a pair of armholes. The vest front panel has a first means for opening the vest. The vest front panel and the vest rear panel each have an inner surface and an outer surface. A first plurality of pockets cover the outer surface of the vest front panel and the vest rear panel. The vest further includes a means for releasably attaching a pair of detachable sleeves to the pair of armholes. The inner jacket has a front panel, a rear panel and a pair of sleeves. The front panel has a second means for opening the inner jacket. The front panel and the rear panel each has an interior surface and an exterior surface. The exterior surface of the rear panel has a pouch. A second plurality of pockets covers the pouch and the exterior surface of the front panel and the rear panel. The inner jacket has a collar which has a means for containing a collapsible hood. The vest has a means for fastening and the inner jacket has a complementary means for fastening the vest to the inner jacket to form a first composite jacket. The first composite jacket has an outside surface and an inside surface, wherein the outside surface is the exterior surface of the front panel and the rear panel and the inside surface is the outer surface of the vest front panel and the vest rear panel. The outer jacket has a jacket front panel, a jacket rear panel and a first pair of sleeves. The jacket front panel has a third means for opening the outer jacket. The jacket front panel and the jacket rear panel each has an internal surface and an external surface. A third plurality of pockets cover the external and the internal surface of the jacket front panel and the jacket rear panel. The outer jacket has a first collar which has a means for removably attaching a hood. It further has a means for enclosingly fastening the outer jacket to the first composite jacket to form a second composite jacket. The means for enclosingly fastening has a first member extending around an outer seam of the first composite jacket and a complementary second member extending around an outer seam of the outer jacket. The second composite jacket has an innermost surface and an outermost surface, wherein the innermost surface is the outer surface of the vest front panel and the vest rear panel and the outermost surface is the external surface of the jacket front panel and the jacket rear panel.

BRIEF DESCRIPTION OF THE DRAWINGS

The present invention should be more fully understood when the specification herein is taken in conjunction with the drawings appended thereto, wherein.

DETAILED DESCRIPTION OF THE PRESENT INVENTION

The present invention is a three piece all season clothing garment which is convertible between three layers, namely, a vest with or without sleeves, an inner jacket and an outer jacket. Furthermore, the vest can be combined with the inner jacket to create .a first composite jacket. The first composite jacket can then be combined with the outer jacket to create a second composite jacket. As such, the clothing garment can be worn with all three layers connected or in a single layer fashion. This triple layer attachability provides greater flexibility in use during the entire year. Each layer has a plurality of pockets which cover both the front and back of the individual layer. In combination form, the garment has pockets lining the inside and outside surfaces. The pockets may be detachable.

The vest and the inner jacket are joined using fasteners which extend along the outer seam of the vest and inner jacket. The inner jacket and outer jacket are joined via a continuous fastener which runs along the outer seam of the inner jacket and outer jacket, including the neck portion. This provides the most complete enclosability to the user and helps in retaining and maintaining the thermal comfort of the user.

Figure 1:
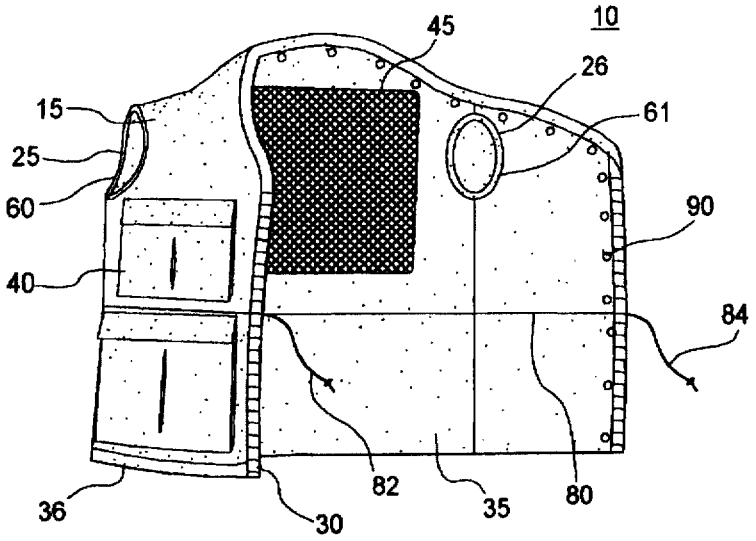
FIG. 1 shows a front view of an embodiment of the vest layer of the present invention.
Figure 2:
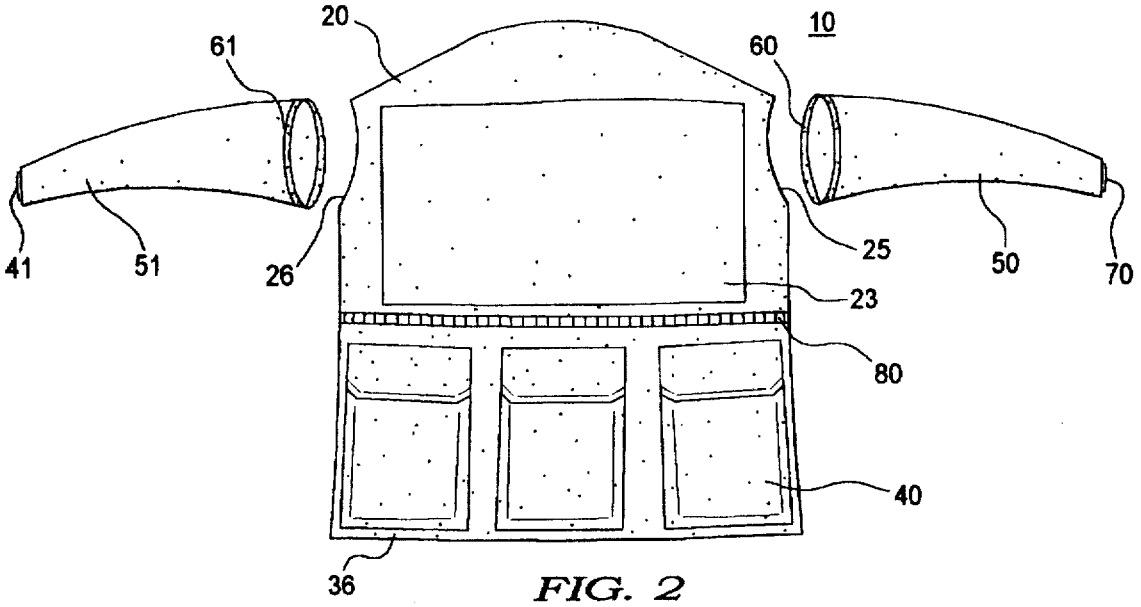
FIG. 2 shows a back view of the vest embodiment shown in FIG. 1.

Referring to FIGS. 1 and 2, a front and rear view of a vest 10 is shown. Vest 10 has a front panel 15, a rear panel 20 and a pair of armholes 25 and 26. Front panel 15 has a fastener 30 for opening and closing vest 10. Fastener 30 can be a zipper, filamentary loop and hook mechanisms, or other similar attachment mechanisms. Front panel 15 and rear panel 20 further have an inner surface 35 and an outer surface 36. A plurality of pockets 40 cover outer surface 36. Pockets 40 are of assorted sizes, namely, small, medium and large and are opened/closed using conventional closure mechanisms. Pockets 40 may be of the detachable type. As such, the user can modify the carrying capacity of vest 10 easily and without having to change garments or carry extra jackets. Since vest 10 is more likely to be worn during warmer weather, a mesh panel 45 is provided on rear panel 20. A flap 23 overlays mesh panel 45 to provide protection from the sun.

If needed, a pair of detachable sleeves 50 and 51 can be attached at arm holes 25 and 26, respectively. Detachable sleeves 50 and 51 are attached to armholes 25 and 26 via fastening mechanism 60 and 61. Fastening mechanism 60 and 61 is preferably implemented using filamentary loop and hook mechanisms and/or zippers. However, other attachment mechanisms can be used. Detachable sleeves 50 and 51 have elastic cuffs 70 and 71 for better fit. A drawstring 80, having ends 82 and 84, is also provided to obtain a tighter and better fit.

Figure 3:
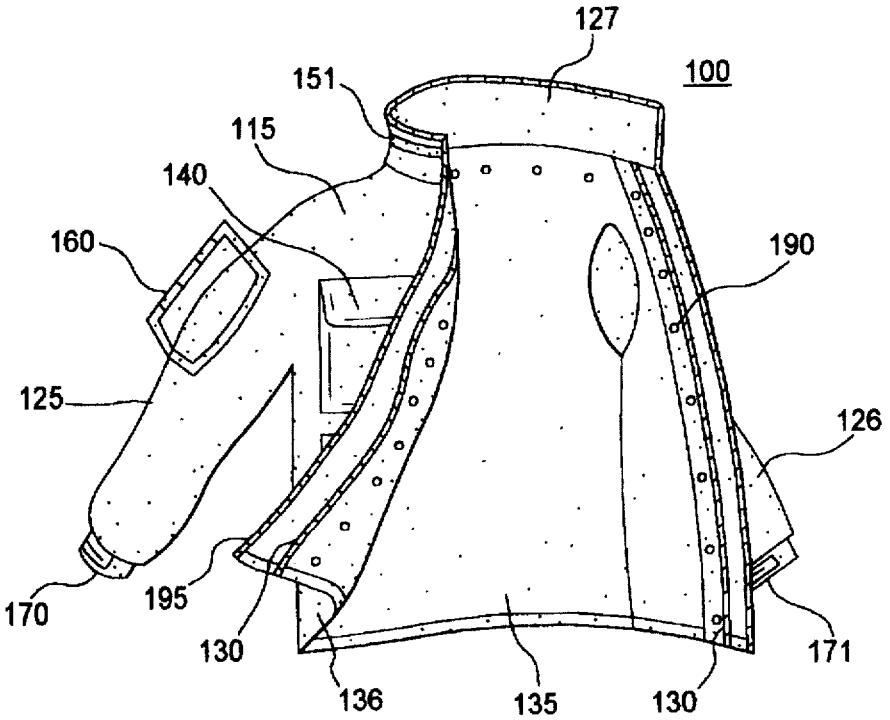
FIG. 3 shows a front view an embodiment of an inner jacket of the present invention.
Figure 4:
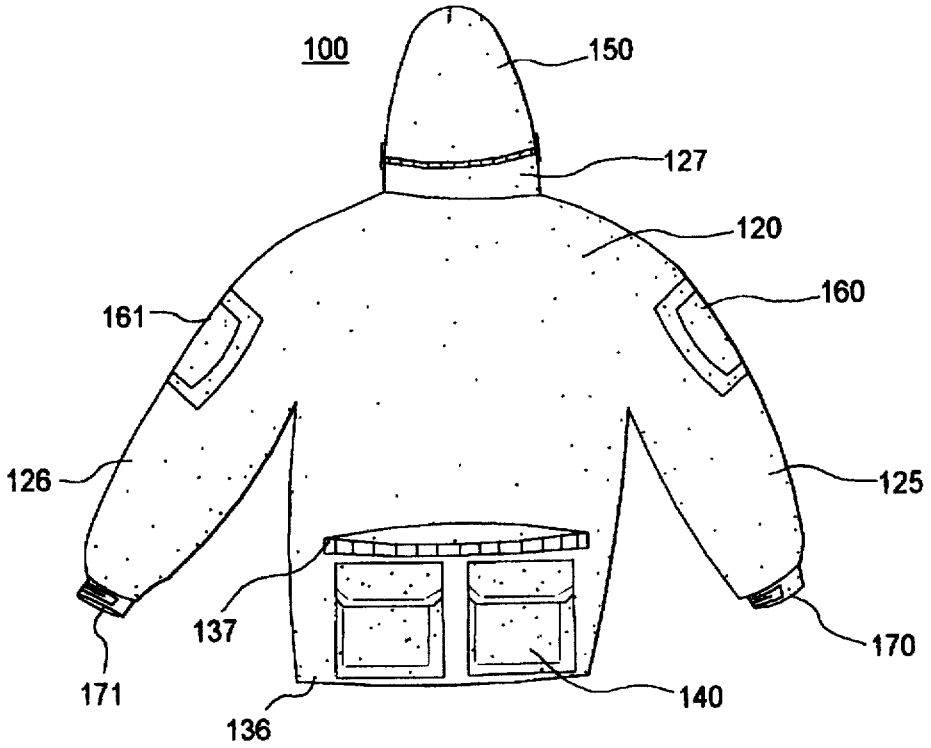
FIG. 4 shows a rear view of the embodiment shown in FIG. 3.
Figure 5:
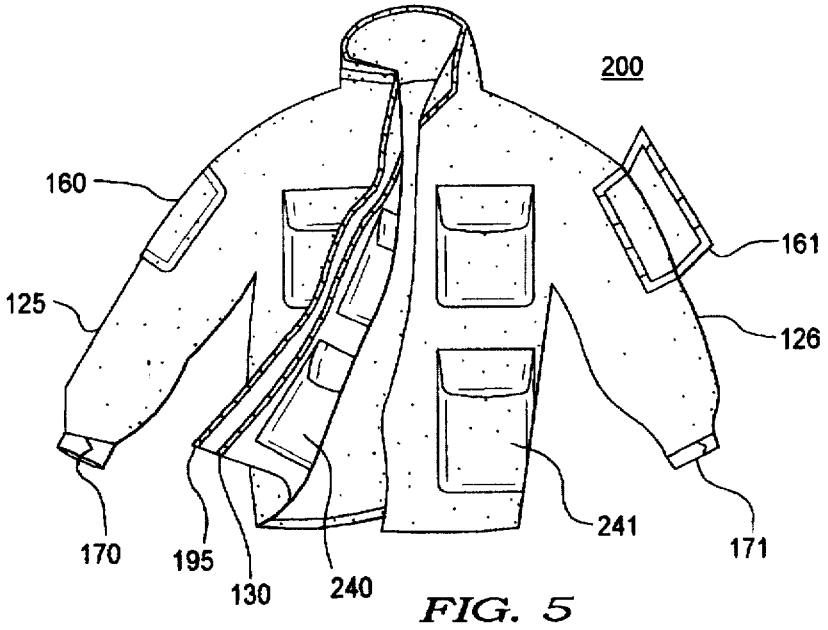
FIG. 5 shows a front view of an embodiment of a combined vest and inner jacket of the present invention.

As mentioned above, vest 10 can be attached to an inner jacket 100 (as shown in FIGS. 3–5). This is preferably accomplished using complementary attachment mechanisms such as snaps 90 and will be detailed below. Filamentary loop and hook mechanisms and other such fastening devices can also be used.

Referring now to FIGS. 3 and 4, a front view and rear view of inner jacket 100 is shown. Inner jacket 100 has a front panel 115, a rear panel 120, a pair of sleeves 125 and 126, and a collar 127. Front panel 115 has a fastener 130 for opening and closing inner jacket 100. Front panel 115 and rear panel 120 further have an inner surface 135 and an outer surface 136. Outer surface 136 of rear panel 120 has a pouch 137, which provides additional storage capacity. A plurality of pockets 140 cover outer surface 36 and pouch 137. That is, pouch 137 and pockets 140 form a double pocket combination. More storage area is provided by placing a pair of pockets 160 and 161 on sleeves 125 and 126, respectively. Pockets 160 and 161 are accessed from the side. Inner jacket 100 provides adjustable cuffs 170 and 171 to give better fit. Added protection from the rain or wind is provided by collapsible hood 150, which is located inside collar 127. Collapsible hood 150 is accessed by opening zipper 151 and pulling out collapsible hood 150.

Figure 6:
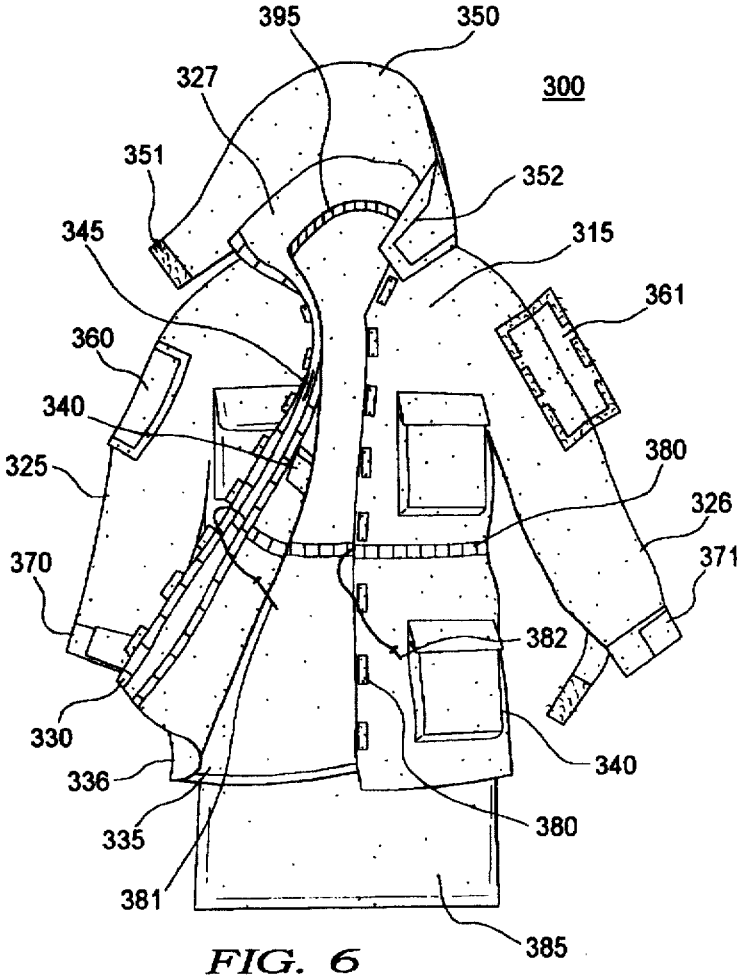
FIG. 6 shows a front view of an embodiment of the outer jacket of the present invention.
Figure 7:
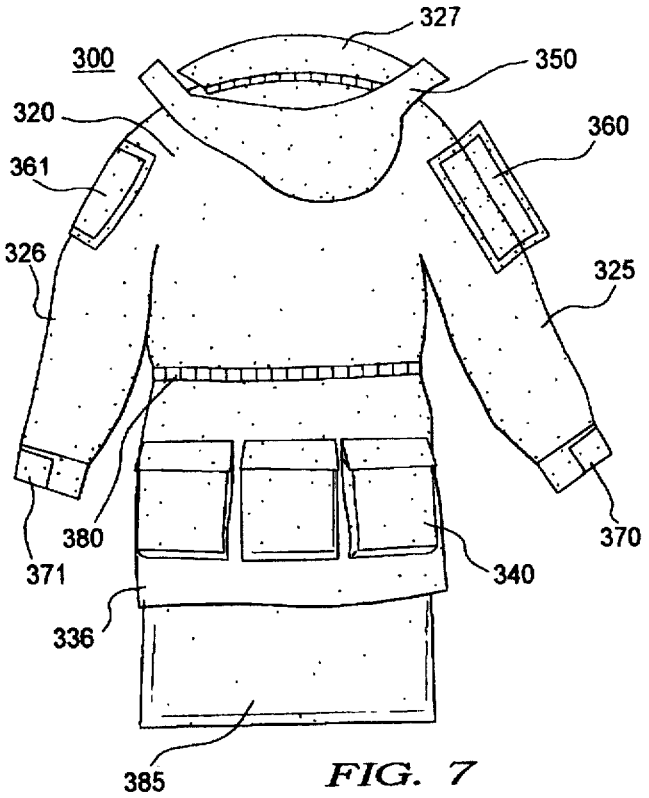
FIG. 7 shows a rear view of the embodiment shown in FIG. 6.

As mentioned above, inner jacket 100 can be attached to vest 10 and/or to outer jacket 300 (as shown in FIGS. 6 and 7). Note that identical parts are identically numbered in FIG. 5. Referring now to FIG. 5, attachment to vest 10, to form a first composite jacket 200, is done by mating snaps 90 to snap complements 190. This first requires that vest 10 be turned inside out and then be snapped to inner jacket 100. As a result, pockets 40 of vest 10 become the internal pockets 240 of first composite jacket 200 and the external pockets 241 are pockets 140 of inner jacket 100. First composite jacket 200 therefore has pockets lining both sides of jacket 200. This feature increases the carrying capacity and usefulness of first composite jacket 200. Attachment to outer jacket 300 is accomplished via continuous fastener 195, which extends along the entire outer seam of inner jacket 100, including along collar 127. Continuous fastener 195 thus provides a complete seal between inner jacket 100 and outer jacket 300. This provides the most complete seal between inner jacket 100 and outer jacket 300.

Referring now to FIGS. 6 and 7, a front and rear view of outer jacket 300 is shown. Outer jacket 300 has a front panel 315, a rear panel 320, a pair of sleeves 325 and 326, and a collar 327. Front panel 315 has a fastener 330 for opening and closing outer jacket 300. Front panel 315 and rear panel 320 further have an inner surface 335 and an outer surface 336. A plurality of pockets 340 cover inner surface 335 and outer surface 336. More storage area is provided by placing a pair of pockets 360 and 361 on sleeves 325 and 326, respectively. Pockets 360 and 361 are accessed from the side. Pockets 340, some of which are located on the bottom of outer surface 336 of front panel 315, also have side access. Outer jacket 300 also has seam pockets 345, which as the name implies, are along the seam of outer jacket 345 and are used to carry pens, whistles and other such items.

Outer jacket 300 provides adjustable cuffs 370 and 371 to give better fit and comfort. Added protection from the rain, snow or wind is provided by detachable hood 350, which is attachable at a base of collar 327 with filamentary loop and hook mechanisms, zippers, snaps or other similar detachable mechanisms. Detachable hood 350 further has enclosures 351 and 352 which can be fastened together to prevent exposure of the face of the user from the cold. The user can also get a closer and snug fit by using drawstring 380, which has ends 381 and 382, to tighten outer jacket 300 around the user. More added protection to the user is provided by detachable apron 385. Detachable apron 385 allows the user to sit safely and/or drily on wet and/or cold benches and other like areas. It also helps reduce the amount of water and/or air that may hit the user's legs and/or flow up the back of outer jacket 300. Detachable apron 385 is preferably attached to the interior, bottom surface of rear panel 320 using releasable attachment mechanisms. Flaps 380 are provided on front panel 315 to additionally seal outer jacket 300 and fits over fastener 330. Throughout this description, detachable generally indicates the preferred usage of filamentary loop and hook mechanisms to attach/detach the item of interest. Other similar mechanisms can be used.

Figure 8:
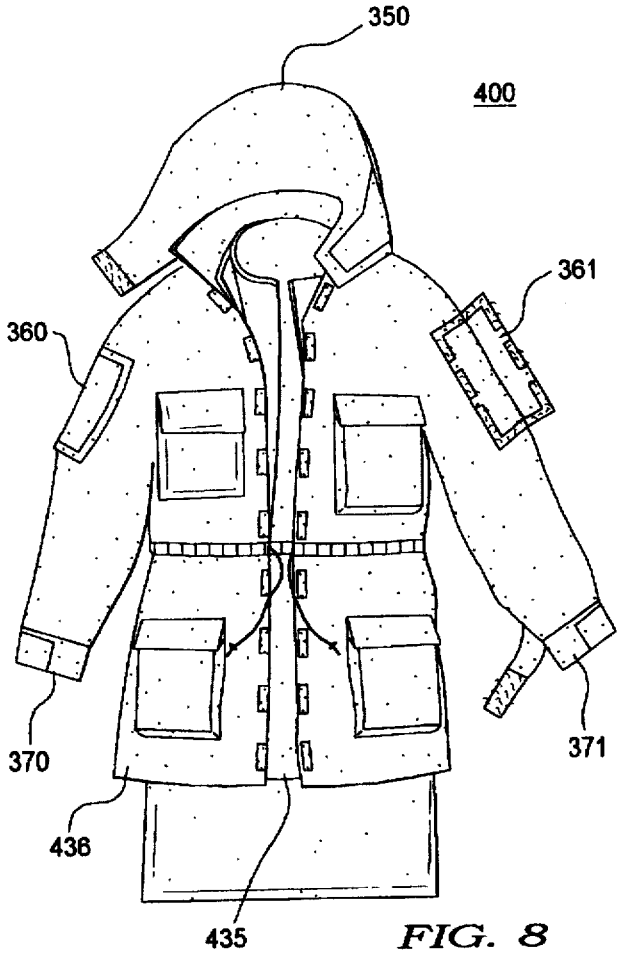
FIG. 8 shows a front view of an embodiment of a combined vest, inner jacket and outer jacket of the present invention.

As stated above, outer jacket 300 can be connected to first composite jacket 200 to form a second composite jacket 400, which would then have a three layer construction. Outer jacket 300 could also be connected to inner jacket 100 to form a two layer jacket. Outer jacket 300 has a complementary continuous fastener 395 which extends along the outer seam of outer jacket 300 including the neck portion. Referring to FIG. 8, when continuous fastener 195 and complementary continuous fastener 395 are joined, second composite jacket 400 is assembled. In this combination, inner surface 35 of vest 10 becomes an inner surface 435 of second composite jacket 400 and outer surface 336 of outer jacket 300 becomes an outer surface of second composite jacket 400. As a consequence, second composite jacket 400 has pockets on all surfaces and has three layers of material for thermal insulation.

Vest 10, inner jacket 100 and outer jacket 300 are preferably constructed out of materials which provide protection from wet, windy, cold conditions or a combination thereof. Vest 10, since it is primarily for the summer, is preferably constructed from nylon, light canvas, cotton and other such materials. A water resistant and/or repellant material may be used or coated on. The object is to make it light and comfortable, but also useful. Inner jacket 100 is preferably constructed from polyester, nylon, polyethylene, polypropylene, water repellant materials, and water resistant materials. In addition, inner jacket 100 could also use thermally insulating materials on the exterior surfaces and/or as inner insulation. The inner facing surfaces could in addition to the above, be constructed from fleece, wool, cotton or a combination of any the above listed materials. Again, the object is to keep the weight to a minimum, but provide effectivity against the weather. Outer jacket 300 is constructed similarly to inner jacket 100.

Obviously, numerous modifications and variations of the present invention are possible in light of the above teachings. It is therefore understood that within the scope of the appended claims, the invention may be practiced otherwise than as specifically described herein.

What is claimed is:

1. A multi-compartment, modular clothing, comprising:

a) a vest having a vest front panel, a vest rear panel and a pair of armholes, said vest front panel having a first fastening means for opening and closing said vest;

b) said vest front panel and said vest rear panel each having an inner surface and an outer surface;

c) a first plurality of pockets covering said outer surface of said vest front panel and said vest rear panel;

d) means for releasably attaching a pair of detachable sleeves to said pair of armholes;

e) an inner jacket having a front panel, a rear panel and a pair of sleeves, said front panel having a second fastening means for opening and closing said inner jacket;

f) said front panel and said rear panel each having an interior surface and an exterior surface;

g) said exterior surface of said rear panel having a pouch;

h) a second plurality of pockets covering said pouch and said exterior surface of said front panel and said rear panel;

i) said inner jacket having a collar, said collar having means for containing a collapsible hood;

j) said vest having a third fastening means for fastening said vest to said inner jacket through a complementary fastening means located on said inner jacket, said vest fastened to said inner jacket forming a first composite jacket;

k) said first composite jacket having an outside surface and an inside surface, wherein said outside surface is said exterior surface of said front panel of said inner jacket and said rear panel of said inner jacket and said inside surface is said outer surface of said vest front panel and said vest rear panel;

l) an outer jacket having a jacket front panel, a jacket rear panel and a first pair of sleeves, said jacket front panel having a fourth fastening means for opening and closing said outer jacket, said jacket front panel and said jacket rear panel each having an internal surface and an external surface;

m) a third plurality of pockets covering said external and said internal surface of said jacket front panel and said jacket rear panel;

n) said outer jacket having a first collar, said first collar having means for removably attaching a hood;

o) means for enclosingly fastening said outer jacket to said first composite jacket to form a second composite jacket, said means for enclosingly fastening having a first member extending around an outer seam of said first composite jacket and a complementary second member extending around an outer seam of said outer jacket;

p) said second composite jacket having an innermost surface and an outermost surface, wherein said innermost surface is said outer surface of said vest front panel and said vest rear panel and said outermost surface is said external surface of said jacket front panel and said jacket rear panel.

2. The clothing as recited in claim 1, further including a fourth plurality of pockets covering said pair of sleeves and said first pair of sleeves.

3. The clothing as recited in claim 2, wherein said vest rear panel has a mesh portion.

4. The clothing as recited in claim 3, wherein said jacket rear panel further includes a detachable apron.

5. The clothing as recited in claim 4, wherein said jacket front panel further includes on seam pockets.

6. The clothing as recited in claim 5, wherein said jacket front panel further includes a plurality of flap closures adjacent to said fourth fastening means for opening and closing.

7. The clothing as recited in claim 6, wherein said third plurality of pockets and said fourth plurality of pockets have side entry means.

8. The clothing as recited in claim 7, wherein said first plurality of pockets, said second plurality of pockets, said third plurality of pockets and said fourth plurality of pockets are detachable.

9. A multi-compartment, modular garment, comprising:

a) a vest having a first means for opening and closing, an inner surface, an outer surface, and a means for releasably attaching a pair of detachable sleeves to said vest;

b) a first plurality of pockets covering said outer surface;

c) an inner jacket having a pair of sleeves, a second means for opening and closing, an interior surface and an exterior surface;

d) said exterior surface having a pouch on a back portion of said inner jacket;

e) a second plurality of pockets covering said pouch and said exterior surface;

f) means for fastening said vest to said inner jacket, said vest fastened to said inner jacket forming a composite jacket wherein an outside surface of said composite jacket is said exterior surface of said inner jacket and an inside surface of said composite jacket is said outer surface of said vest;

g) an outer jacket having a first pair of sleeves, a third means for opening and closing, an internal surface, and an external surface;

h) a third plurality of pockets covering said external surface and said internal surface;

i) means for enclosingly fastening said outer jacket to said inner jacket, said means for enclosingly fastening extending around an outer seam of said inner jacket and said outer jacket, wherein an innermost surface is said outer surface of said vest and outermost surface is said external surface of said outer jacket.

10. The garment as recited in claim 9, wherein a back portion of said vest has a mesh panel.

11. The garment as recited in claim 10, wherein said inner jacket further includes a collar, said collar having a collapsible hood.

12. The garment as recited in claim 11, wherein said outer jacket further includes a detachable hood.

13. The garment as recited in claim 12, further including a fourth plurality of pockets covering said pair of sleeves and said first pair of sleeves.

14. The garment as recited in claim 9, wherein said outer jacket further includes a detachable apron.

15. The garment as recited in claim 9, wherein said outer jacket further includes on seam pockets.

16. The garment as recited in claim 9, wherein said third plurality of pockets and said fourth plurality of pockets have side access.

17. The garment as recited in claim 9, wherein said outer jacket further includes a plurality of flap closures adjacent to said third means for opening and closing.

18. The garment as recited in claim 9, wherein said first plurality of pockets, said second plurality of pockets, said third plurality of pockets and said fourth plurality of pockets are detachably attached.

19. The garment as recited in claim 9, wherein a fourth plurality of pockets cover said pair of sleeves and said first pair of sleeves.

20. The garment as recited in claim 9, wherein said inner jacket further includes a collar, said collar having a collapsible hood.

* * * * *